United States Patent [19]

Shen et al.

[11] Patent Number: 5,072,796

[45] Date of Patent: Dec. 17, 1991

[54] BORING BIT

[75] Inventors: Zhonghou Shen; Yiji Xu; DeXin Wang, all of Shandong, China

[73] Assignee: University of Petroleum, China, Shandong, China

[21] Appl. No.: 525,922

[22] Filed: May 18, 1990

[30] Foreign Application Priority Data

May 19, 1989 [CN] China ..... 89207234.2

[51] Int. Cl.[5] ..... E21B 10/18; E21B 10/60

[52] U.S. Cl. ..... 175/340; 175/424

[58] Field of Search ..... 175/340, 424, 393

[56] References Cited

U.S. PATENT DOCUMENTS

| | | | |
|---|---|---|---|
| 2,293,259 | 8/1942 | Johnson | 175/340 X |
| 2,710,741 | 6/1955 | Hall, Sr. | 175/340 X |
| 3,363,706 | 1/1968 | Feenstra | 175/340 |
| 3,393,756 | 7/1968 | Mori | 175/424 X |
| 3,419,220 | 12/1968 | Goodwin et al. | 175/340 X |
| 3,509,952 | 5/1970 | Galle | 175/424 X |
| 4,077,482 | 3/1978 | Ioannesian et al. | 175/340 |
| 4,106,577 | 8/1978 | Summers | 175/340 |
| 4,687,067 | 8/1987 | Smith et al. | 175/340 |
| 4,759,415 | 7/1988 | Pessier | 175/340 |

FOREIGN PATENT DOCUMENTS

| | | | |
|---|---|---|---|
| 1023419 | 3/1966 | United Kingdom | 175/340 |

*Primary Examiner*—Stephen J. Novosad

*Attorney, Agent, or Firm*—Kinney & Lange

[57] ABSTRACT

A boring bit for drilling is provided comprising one set of rotatable toothed wheels secured thereon as well as one set of tubular nozzles and one central nozzle for injecting drilling fluid from a chamber in bit body toward the bottom of a borehole. The boring bit comprises the inlet end of said tubular nozzle being secured on the bit body and connected with said chamber while its outlet end is quite close during operation to the lowest point of toothed wheels and the bottom of a borehole, and the fluid passage of said tubular nozzle from the inlet end to the outlet end is straight and cylindrical. Branch fluid passages are provided on the main fluid passage of said central nozzle for washing and cooling toothed wheels.

11 Claims, 2 Drawing Sheets

BORING BIT

BACKGROUND OF THE INVENTION

This invention relates to improvements in a boring bit, particularly to improvements in tubular nozzles in a boring bit.

During operation, the earliest tubular nozzles and central nozzle in a boring bit are intended to directly inject high speed and high pressure fluid toward the bottom of a borehole while the boring bit is rotating, so as to promote the breaking of touched rock and wash and cool the boring bit, as a result, drilling efficiency is enhanced and bit life is prolonged.

Experiments have proved that the closer the outlet end of a tubular nozzle is to the bottom of a borehole, the higher is the pressure of drilling fluid injected toward the bottom of a borehole, as a result, a higher effect is achieved. Therefore, there has recently been developed a boring bit with extended tubular nozzles of which the lower ends are at a distance substantially equivalent to 2 to 6 nozzle diameters from the bottom of a borehole, which leads to the best result.

U.S. Pat. No. 4,759,415 discloses such a boring bit with extended nozzle tubes. Although its performance is higher than that of the earlier one, however, with a curved region in its nozzle tubes, improvement of bit life is hindered as a result of the fact that high speed and high pressure drilling fluid passing through the curved region deflects fluid, and by violently impinging thereagainst erodes the wall thereof. Furthermore, the curved region increases loss of pressure of drilling fluid and thereby unfavorably influences the enhancing of efficiency.

The object of the invention is to provide a boring bit without the above-mentioned drawback, however with even longer life and higher efficiency.

SUMMARY OF THE INVENTION

The object of the invention is achieved by providing a boring bit with straight cylindrical fluid passage in each of its tubular nozzles without any curved region, the outlet end (lower end) of said tubular nozzle being extended and made close to the bottom of a borehole during operation, and the fluid passage in the tubular nozzle being formed by one or one set of bushings which is (are) made of hard antifriction erosion-resistent material and has (have) the same diameter along axes thereof.

Branch fluid passages are provided on the main fluid passage in the central nozzle of the boring bit in order to lead drilling fluid toward toothed wheels which are thereby washed and cooled.

DETAILED DESCRIPTION OF THE PREFERRED EMBODIMENTS

Figure 1:
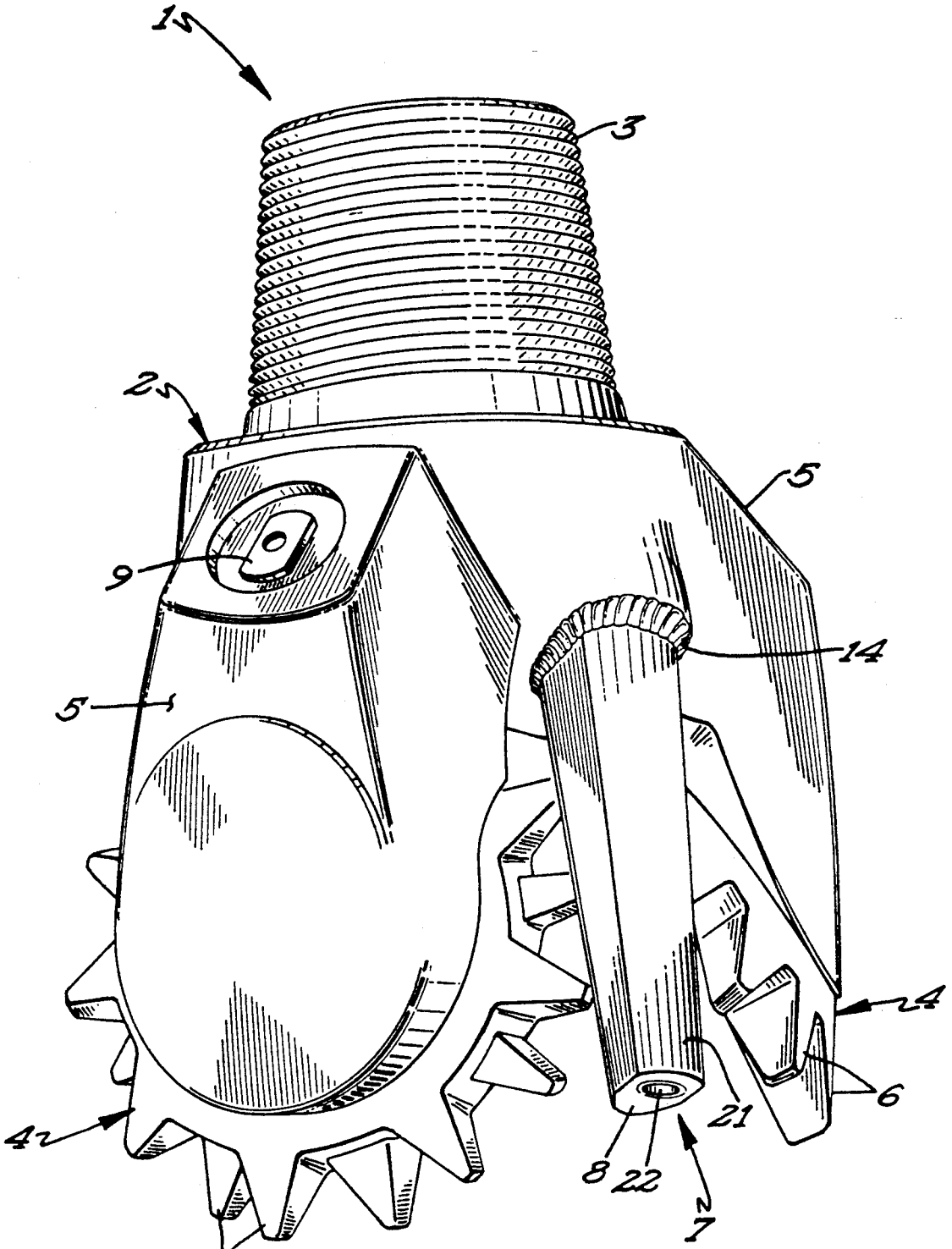
FIG. 1 is a perspective view of the boring bit with straight and extended tubular nozzles according to the invention.

In FIG. 1 is shown a boring bit 1 with its body 2 according to the invention. The upper part of the bit body 2 forms the threaded head 3 to be connected during operation to the threaded part of the drilling string (not shown). On the lower part of the boring bit 2 are mounted three toothed wheels 4, arranged at equal distance one from the other, pending downward from the bit body 2, supported through bearing shafts (not shown) in the supporting part 5 extending downward from the bit body 2, thereby being capable of rotating around their own axes. Teeth 6 of the toothed wheels 4 engage the bottom of a borehole and break the touched rock when the toothed wheels 4 rotate during operation. In the space between each two toothed wheels there exists a tubular nozzle 7 for drilling fluid, extending from the bit body 2. High pressure drilling fluid (for example, drilling sludge) is injected from the outlet ends 8 of these three tubular nozzles 7 toward the bottom of a borehole during operation so as to cool the boring bit and clear away rocky debris on the bottom of a borehole. Between each toothed wheel and its bearing shaft there exist lubricating and sealing systems, of which only one sealing cap 9 is shown in FIG. Between the three toothed wheels 4 is further provided a central nozzle (not shown in FIG. 1), extending downward from the bit body 2 along the central axis of the boring bit 1, intended to inject drilling fluid toward the toothed wheels 4 to be washed.

Figure 2:
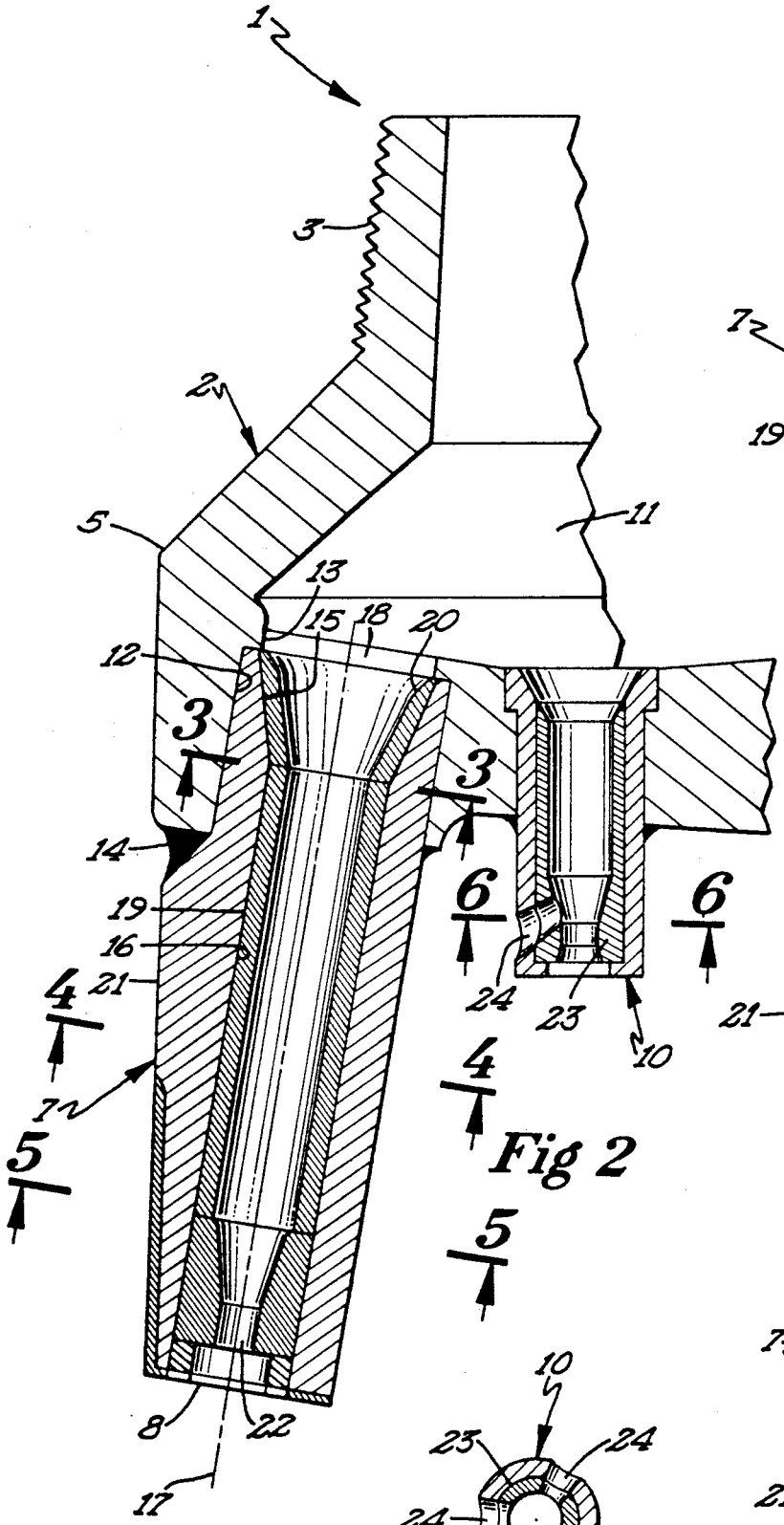
FIG. 2 is a cross-sectional view of the straight and extended tubular nozzle and central nozzle according to the invention.

FIG. 2 is a cross sectional view showing the tubular nozzle 7 and central nozzle 10. In the bit body 2 is a chamber 11, on the lower side of which are three holes 12 open to said chamber and extending downward for mounting tubular nozzles 7. In each hole 12 a boss 13 is arranged for limiting the upward displacement of the inlet end 18 of the tubular nozzle 7 which has its upper end inserted in the hole 12 through its surface corresponding to hole 12, and is secured by welding 14 to the bit body 12 and is connected in liquid seal manner with the chamber 11.

Figure 3:
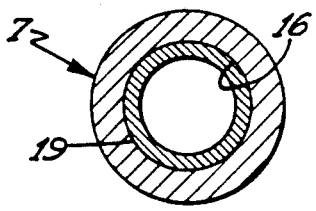
FIG. 3–6 are cross section views respectively along the lines 3—3, 4—4, 5—5 and 6—6, in FIG. 2.

As shown in FIG. 2, the tubular nozzle 7 has, except at the inlet end 18 (upper end), a straight cylindrical inner hole 16 with the same inner diameter along its axis 17. At the inlet end 18 of the tubular nozzle is a tapered hole 15 with its larger end toward the chamber 11. In the inner hole 16 of the tubular nozzle 7 are secured one or one set of superposed bushings 19, made of antifriction erosion-resistent material such as hard alloy, with the same inner and outer diameters along its or their axes, the outer diameter thereof being approximately equal to the inner diameter of the inner hole 16 so as to insert the bushing into the inner hole 16 as shown in FIG. 3. At the inlet end 18 of the tubular nozzle a tapered bushing 20 is secured in the tapered hole 15, with its outer surface corresponding to the inner surface of the tapered hole 15, the larger end of its tapered inner surface being sized the same as the hole 12 of the chamber 11 and the small end of its inner surface being equal to and connected with the upper end of the bushing 19. The bushings 19 and the tapered bushings 20 are all by welding or binding secured respectively in the inner holes 16 and 15 of the tubular nozzles so that the inner holes of the bushings 19 and 20 provide a passage for drilling fluid from the chamber 11 with jet means 22 at their outlets. Due to the convergent inner surface of the tapered bushing 20, the, flow rate of drilling fluid from the chamber 11 when it passes through the tapered bushing 20 gradually increases.

It is thus evident that, due to the straight fluid passage, formed in the bushing 19 in the tubular nozzle 7, with the same inner diameter along its axis and without any curved region which would deflect the high pressure drilling fluid, the pressure loss of high pressure drilling fluid passing through the tubular nozzle 7 is further reduced to minimum, which promotes drilling fluid to be injected at a velocity as high as possible to the bottom of a borehole, thereby the drilling rate and efficiency are distinctly enhanced. In the meanwhile, in the absence of the curved region which would deflect the drilling fluid, the erosion of the tubular nozzle caused by high pressure fluid is greatly reduced and its life prolonged.

Moreover, due to the fact that the bushing which forms the fluid passage is made of anti-friction erosion-resistent material such as hard alloy, on the one hand the tubular nozzle 7 is strengthened, on the other hand the outer diameter of the tubular nozzle 7 is reduced as far as possible under premise of unimpaired strength of the tubular nozzle 7, which makes it possible to arrange the tubular nozzle 7 in the narrow space between two toothed wheels without interfering the turning of said toothed wheels. The inner hole 16 of the tubular nozzle is more easily machined up due to its straight cylindrical form, whereby the production cost of a boring bit its reduced.

Figure 4:
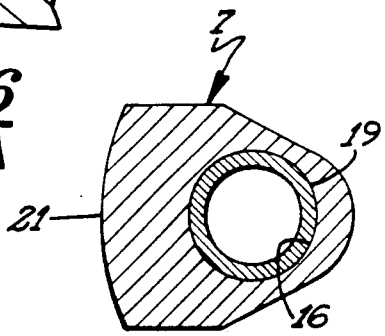
Figure 6:
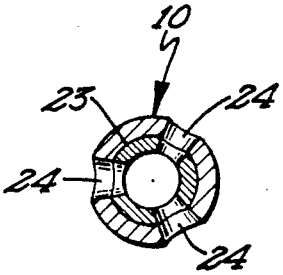
Figure 5:
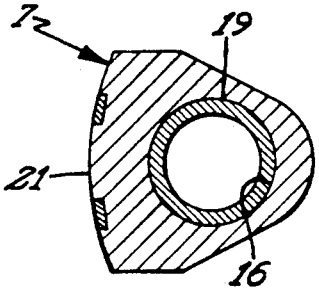

Furthermore, as shown in FIG. 2, the axis 17 of the tubular nozzle 7 makes an small angle with the axis of the bit body 2, so that the tubular nozzle 7 has its outer wall 21 thicker at upper end and gradually thinning down as extending to the lower end, as shown in FIGS. 4 and 5, and the outlet end 8 of the tubular nozzle is as close as possible to the lowest point of the toothed wheel. When the lower part of the tubular nozzle contacts the wall of a borehole or rocky debris on the bottom of a borehole, the tubular nozzle as a cantilever bears great force and would break quite easily with its weak root part, however, according to the invention the root part 21 of the tubular nozzle is sufficiently thickened, thereby the tubular nozzle is strengthened and its service life prolonged.

From FIG. 1 it can be seen that the outlet end 8 of the straight tubular nozzle 7 is quite close to the lowest point of toothed wheel, approximately at a distance equivalent to 4 to 6 diameters of the nozzle outlet above the lowest point of the toothed wheel, that is to say, the outlet end 8 is quite close to the bottom of a borehole during operation. With the extended straight and tubular nozzle the traveling distance of the drilling fluid from the jet means 22 to the bottom of a borehole is shortened, which enhances the capacity of fluid injected toward the bottom of a borehole by 30 to 40%, thereby enhances the drilling rate.

As shown in FIG. 2, the central nozzle 10 has its central axis coinciding with that of the bit body, with its upper part secured through welding on the bit body 2 and its lower part extending outward from the bit body 2. In the inner hole of the central nozzle 10 is secured a bushing 23, made of anti-friction erosion-resistent material, in the same manner as the bushing 19. The inner hole of the bushing 23 forms the main passage of the drilling fluid. Through the wall on the lower part of the central nozzle 10 are pieced plurality of holes 24 as branch passages of drilling fluid. The central axis of the hole 24 makes an angle with the central axis of the bit body 2 and is directed toward toothed wheel. The drilling fluid from the chamber 11 passing through, the branch passages is injected toward toothed wheels so as to wash and cool them.

What is claimed is:

1. A boring bit for drilling, comprising one set of rotatable toothed wheels secured thereon as well as one set of tubular nozzles for injecting drilling fluid from a chamber in the bit body toward the bottom of a borehole, the boring bit comprising:

an inlet end of each tubular nozzle being secured on the bit body and connected to said chamber and an outlet end of each tubular nozzle positioned during operation approximate the toothed wheels and the bottom of the borehole; and an inner hole of each tubular nozzle for passage of drilling fluid from the inlet end to the outlet end, the inner hole being straight and cylindrical from the inlet end to the outlet end, the inner hole being straight and cylindrical both prior to and during the drilling operations.

2. A boring bit according to claims 1 wherein a fluid passage is formed by a bushing, the bushing being secured in said inner hole of each tubular nozzle, the bushing comprising antifriction erosion-resistant material such as hard alloy and having the same inner diameter and outer diameter along its axis.

3. A boring bit according to claim 2 wherein said fluid passage is formed by one bushing.

4. A boring bit according to claim 2 wherein said fluid passage is formed by one set of superposed bushings.

5. A boring bit according to claim 1 wherein at said inlet end of each tubular nozzle is secured a tapered bushing having a large end and a small end, the large end being connected to said chamber in the bit body, the small end being connected with another bushing.

6. A boring bit according to claim 1 wherein the axis of each tubular nozzle makes a small angle with the axis of the bit body, so that the outer side wall of each tubular nozzle gradually thins down from the inlet end to the outlet end.

7. A boring bit for drilling, comprising one set of rotatable toothed wheels secured thereon as well as one set of tubular nozzles for injecting drilling fluid from a chamber in the bit body toward the bottom of a borehole, the boring bit comprising:

an inlet end of each tubular nozzle being secured on the bit body and connected to said chamber and an outlet end of each tubular nozzle positioned during operation approximate the toothed wheels and the bottom of the borehole; and an inner hole of each tubular nozzle for passage of drilling fluid from the inlet end to the outlet end, the inner hole being straight and cylindrical; and wherein a fluid passage is formed by a bushing, the bushing being secured in said inner hole of each tubular nozzle, the bushing comprising antifriction erosion-resistant material such as hard alloy and having the same inner diameter and outer diameter along its axis.

8. A boring bit according to claim 7 wherein said fluid passage is formed by one bushing.

9. A boring bit according to claim 7 wherein said fluid passage is formed by one set of superposed bushings.

10. A boring bit for drilling, comprising one set of rotatable toothed wheels secured thereon as well as one set of tubular nozzles for injecting drilling fluid from a chamber in the bit body toward the bottom of a borehole, the boring bit comprising:

an inlet end of each tubular nozzle being secured on the bit body and connected to said chamber and an outlet end of each tubular nozzle positioned during operation approximate the toothed wheels and the bottom of the borehole; and an inner hole of each tubular nozzle for passage of drilling fluid from the inlet end to the outlet end, the inner hole being straight and cylindrical; and wherein at said inlet end of each tubular nozzle is secured a tapered bushing having a large end and a small end, the large end being connected to said chamber in the bit body, the small end being connected with another bushing.

11. A boring bit for drilling, comprising one set of rotatable toothed wheels secured thereon as well as one set of tubular nozzles for injecting drilling fluid from a chamber in the bit body toward the bottom of a borehole, the boring bit comprising:

an inlet end of each tubular nozzle being secured on the bit body and connected to said chamber and an outlet end of each tubular nozzle positioned during operation approximate the toothed wheels and the bottom of the borehole; and an inner hole of each tubular nozzle for passage of drilling fluid from the inlet end to the outlet end, the inner hole being straight and cylindrical; and wherein the axis of each tubular nozzle makes a small angle with the axis of the bit body, so that the outer side wall of each tubular nozzle gradually thins down from the inlet end to the outlet end.

* * * * *

UNITED STATES PATENT AND TRADEMARK OFFICE

CERTIFICATE OF CORRECTION

PATENT NO. : 5,072,796

DATED : December 17, 1991

INVENTOR(S) : Zhonghou Shen et al.

It is certified that error appears in the above-identified patent and that said Letters Patent is hereby corrected as shown below:

Col. 4, line 18, delete "claims" and insert --claim--.

Signed and Sealed this

Thirteenth Day of April, 1993

*Attest:*

STEPHEN G. KUNIN

*Attesting Officer*

*Acting Commissioner of Patents and Trademarks*